US005715750A

United States Patent [19]

Goovaard

[11] Patent Number: 5,715,750

[45] Date of Patent: Feb. 10, 1998

[54] PRINTING FORM ATTACHMENT MEANS

[75] Inventor: Jan Goovaard, AH Driebergen, Netherlands

[73] Assignee: Winkle Holding, B.V., Amersfoort, Netherlands

[21] Appl. No.: 669,413

[22] PCT Filed: Jan. 13, 1995

[86] PCT No.: PCT/NL95/00016

§ 371 Date: Sep. 23, 1996

§ 102(e) Date: Sep. 23, 1996

[87] PCT Pub. No.: WO95/19267

PCT Pub. Date: Jul. 20, 1996

[30] Foreign Application Priority Data

Jan. 13, 1994 [NL] Netherlands ..... 9400057

[51] Int. Cl.[6] ..... B41F 27/00

[52] U.S. Cl. ..... 101/382.1; 101/401.1

[58] Field of Search ..... 101/401.1, 395, 101/383, 382.1; 430/14, 271.1

[56] References Cited

U.S. PATENT DOCUMENTS

| | | | |
|---|---|---|---|
| 3,210,187 | 10/1965 | Thommes | 430/271.1 |
| 4,871,631 | 10/1989 | Pieper et al. | 430/14 |

FOREIGN PATENT DOCUMENTS

| | | |
|---|---|---|
| 0281770 | 9/1988 | European Pat. Off. . |
| 0313510 | 4/1989 | European Pat. Off. . |
| 0452808 | 10/1991 | European Pat. Off. . |
| 2214136 | 8/1974 | France . |
| 2848830 | 9/1979 | Germany . |
| 58-160956 | 12/1983 | Japan . |
| 1188396 | 7/1989 | Japan . |
| 1210343 | 8/1989 | Japan . |
| 5179208 | 7/1993 | Japan . |
| 5320593 | 12/1993 | Japan . |

*Primary Examiner*—Christopher A. Bennett
*Attorney, Agent, or Firm*—Panitch Schwarze Jacobs & Nadel, P.C.

[57] ABSTRACT

A printing form attachment device is provided for removably attaching a flexographic printing form made of a photopolymeric material by adhesion on a plate cylinder of a printing press. The printing form attachment device includes a completely exposed photopolymeric printing form attachment layer (3) made of a photopolymeric material located on the plate cylinder (7) for removable adherent attachment of the printing form to the plate cylinder utilizing the adherent and sticky characteristics of the photopolymeric material. A flexible support layer (2) is provided which supports the photopolymeric printing form attachment layer (3).

8 Claims, 1 Drawing Sheet

PRINTING FORM ATTACHMENT MEANS

This invention relates to a printing form attachment means for removably attaching a flexographic printing form by adhesion on a plate cylinder of a printing press, more particularly for removably attaching a printing form of photopolymeric material.

The known printing form attachment means of this type (EP 0 313 510) comprises a strip of double-sided adhesive tape, e.g. supplied from a roll, which is attached with one adherent side on the plate cylinder so that on the other adherent side one or more flexographic printing forms can be attached.

Flexographic printing forms consist of a photopolymeric layer attached to a support layer. Through a film, on which the desired images and/or text etc. have been recorded, the photopolymeric layer is exposed and then washed out, whereafter finally the resulting printing form is subjected to a subsequent treatment.

Reference is made to U.S. Pat. No. 3,210,187 which relates to photopolymeric elements such as printing plates with relief structures as well as processes for making the same.

In case of using the known printing form attachment means the problem arises that the support layer of the printing form adheres strongly to the adherent layer of the double-sided adhesive tape which serves as printing form attachment means, due to which removal of the printing form from the plate cylinder is troublesome and moreover a residual part of the adhesive layer often remains on the printing form. Consequently the printing form attachment means generally has to be replaced after having been used one or several times, whereas on the other hand the printing form has to be cleansed in order to remove the adhesive material. Because the cleansing operation of the printing form is intensive the printing form is commonly thrown away. Thus in case of a repeat order a new printing form has to be produced.

It is an object of this invention to provide a printing form attachment means of the type as mentioned in the preamble, which overcomes these disadvantages in a simple, but nevertheless effective way.

In accordance with the invention the printing form attachment means is characterized in that the printing form attachment means utilizes the adherent and sticky characteristics of a photopolymeric material in that it comprises a completely exposed photopolymeric printing form attachment layer for the removable adherent attachment of the printing form on the plate cylinder as well as a flexible support layer which supports the photopolymeric printing form attachment layer.

The invention relies on the recognition that in order to obtain a particularly effective printing form attachment means advantageously the adherent characteristics of a photopolymeric layer can be utilized. Experiments have shown that these adherent characteristics are maintained in case of intensive use during a period of at least 8 to 12 months. Moreover, on the one hand a good attachment of the printing form on the plate cylinder is realized, whereas on the other hand the printing form can relatively easily be removed from the adherent photopolymeric printing form attachment layer and no residual photopolymeric material remains on the printing form. This results in a long lifetime of the printing form attachment means applied to the plate cylinder, whereas on the other hand the printing form no longer needs to undergo a cleansing operation. Damaging of the printing form by the removal is excluded as well, so that the printing form is available several times for repeat orders without any problem.

Moreover, the printing form attachment means of the invention has the advantage that the photopolymeric layer is highly resistant to the solvents present in the used inks. A further important advantage is achieved in that the photopolymeric layer as compared with the adherent adhesive layers of the known double sided adhesive tape has a considerable thickness of 1–4 mm and a relatively low hardness and preferably is of at least 1.5 mm in thickness. In this way the photopolymeric layer of the printing form attachment means forms a kind of resilient layer between the printing form and the plate cylinder, which results in taking away the unavoidable non-circular shapes of the plate cylinder and printing forms and tolerance due to gear abrasion by the photopolymeric layer. This aspect induces a considerable lifetime increase of the moving parts of the printing press, as well as lifetime increase of the printing form. An accompanying important advantage is that the thickness of the printing form itself can be considerably less than the required thickness, because of the fact that the relatively thick photopolymeric layer of the printing form attachment means already provides an important part of the required total height of the printing thickness above the plate cylinder. It will be understood that application of relatively thin printing forms will induce a considerable economy of 25–40%. Moreover, not only a reduction of cost but also a better printing quality in case of printing on relatively rough materials is achieved.

A particularly advantageous embodiment of the printing form attachment means of the invention is characterized in that reference markers are present on the photopolymeric printing form attachment layer and/or the support layer and are visible through the transparent printing form attachment layer. Advantageously the transparent characteristics of the photopolymeric material for positioning the printing form in the correct position on the plate cylinder are utilized herein. In this way positioning the printing form(s) on the plate cylinder can take place rapidly and precisely, no expensive auxiliary apparatus (such as for example disclosed in EP 0 313 510) for recording different printing forms on subsequent plate cylinders being necessary.

The invention will be explained more in detail by means of the drawings, which illustrate highly schematically an exemplary embodiment of the printing form attachment means of the invention.

Figure 1:
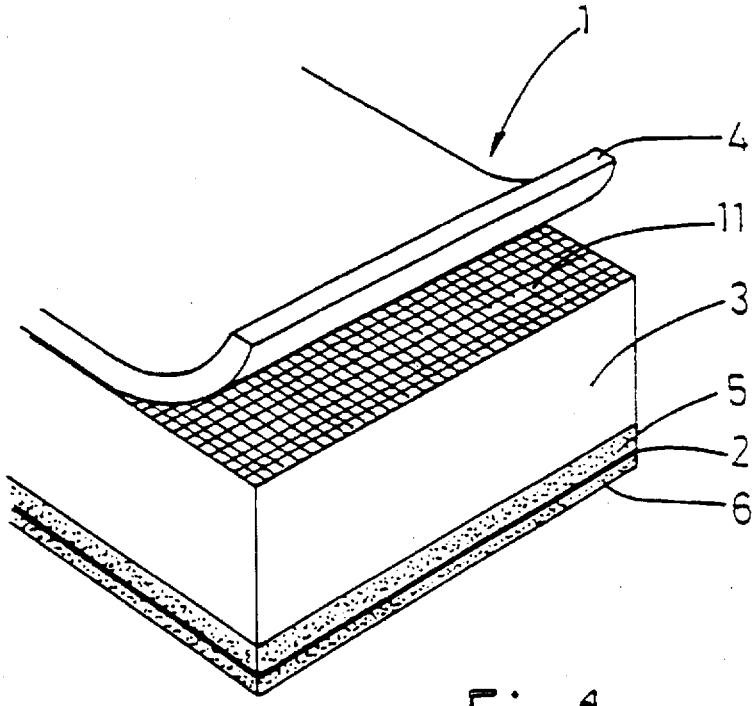
FIG. 1 represents a perspective view of the end of a sheet of an embodiment of the printing form attachment means of the invention applied to a roll (not shown).

In FIG. 1 the end of a sheet of the printing form attachment means 1 is illustrated in a perspective view on a much enlarged scale. It will be understood that in a practical embodiment the printing form attachment means 1 will have a considerably higher width than the width shown in FIG. 1. The printing form attachment means 1 includes a flexible supporting or stabilizing layer 2 consisting of e.g. a polyester material. This supporting layer supports a photopolymeric layer 3 covered by a protective layer 4. For example, this protective layer 4 can consist of polyester as well. In the exemplary embodiment illustrated in FIG. 1 the supporting layer 2 is provided on both sides with an adherent layer 5 and 6 respectively, the adherent layer 5 connecting the photopolymeric layer 3 with the supporting layer 2 and the adherent layer 6 serving to attach the printing form attachment means 1 on a plate cylinder partly visible in FIG. 2. Alternatively the supporting layer 2 can be embodied without the adherent layers 5, 6, the photopolymeric layer being united with the supporting layer 2 in another way and the printing form attachment means being attached on the plate cylinder 7 in another way, e.g. by a commonly used double-sided adhesive tape.

In a convenient embodiment of the protective layer 4 a separate protective layer for the adherent 6 can be omitted when the printing form attachment means 1 is supplied on a roll. Alternatively it is of course possible to apply a separate removable protective layer on the adherent layer 6.

When applying the photopolymeric layer 3 in the printing form attachment means 1 as described above the characteristic of the photopolymeric material being sticky or adherent is utilized advantageously.

In case of application of photopolymeric material for producing flexographic printing forms in a conventional way, for example U.S. Pat. No. 3,210,187, after washing out the printing form a subsequent treatment of the printing form is carried out in order to dissolve the stickiness of the exposed photopolymeric material. The present invention relies on the recognition that this sticky or adherent characteristic of photopolymeric material makes a photopolymeric layer particularly suitable for use as an adherent layer in printing form attachment means as described above. The photopolymeric layer 3 is exposed completely, which results in a further changing of the structure of the photopolymer.

Figure 2:
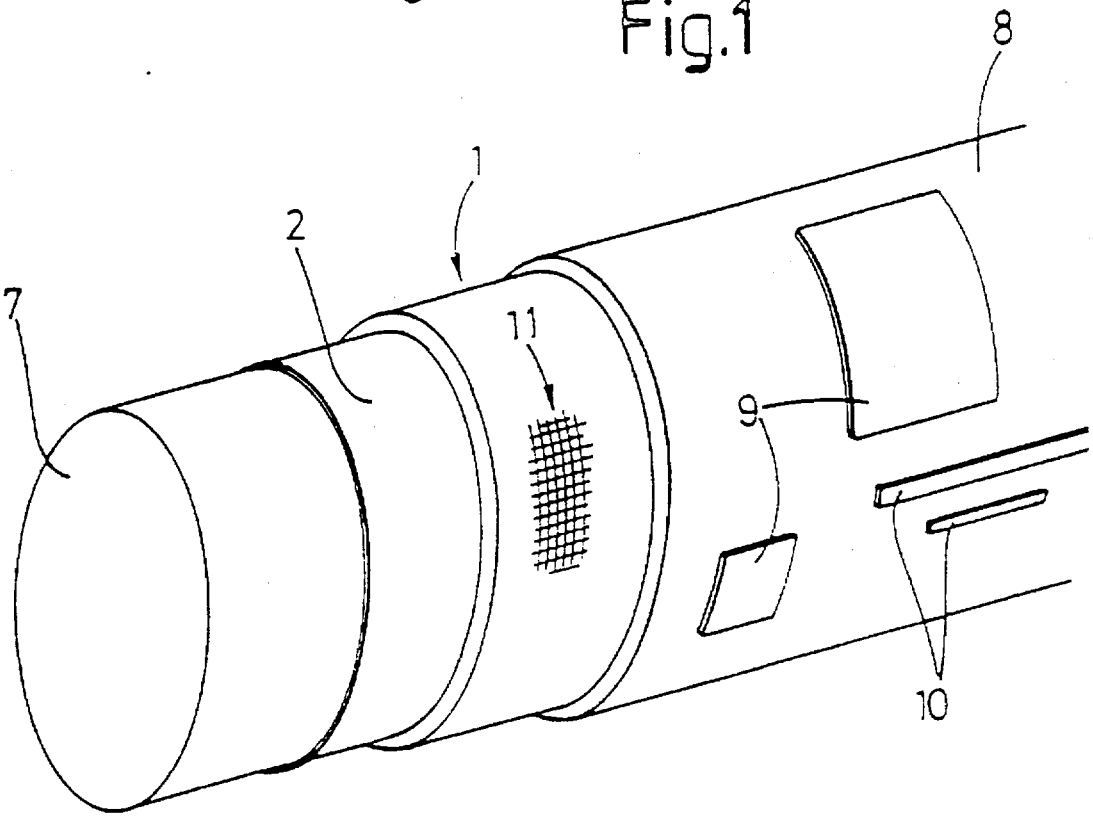
FIG. 2 represents a perspective view of the one end of a plate cylinder, on which a printing form by means of a piece of printing form attachment means of FIG. 1 is applied.

In FIG. 2 the one end of the plate cylinder 7, on which a piece of the printing form attachment means 1 of FIG. 1 is applied, is illustrated in a perspective view. The photopolymeric layer 3 is partially broken away so that the supporting layer 2 is partially visible. Furthermore a printing form 8 is illustrated, on which highly schematically pictures 9 and text 10 are indicated. This printing form 8 is itself embodied in a conventional way with a photopolymeric layer and a supporting layer, on which pictures 9 and text 10 are shaped by way of exposure through a film, then washing out and finally a subsequent treatment in the photopolymeric layer.

Due to the use of the completely exposed photopolymeric layer 3, the printing form attachment means 1 as described above has the advantage that on the one hand the printing form 8 can be attached correctly upon the plate cylinder 7 and on the other hand it can easily be removed as well. In this way no residual material remains on the supporting layer 8 of the printing form so that this printing form 8 needs not undergo any special cleansing operation and does not damage. As a result the printing form 8 maintains its availability for repeat orders. Furthermore the printing form attachment means 1 has the advantage that when removing the printing form 8 the photopolymeric layer 3 does not get damaged so that the printing form attachment means has a long lifetime. Experiments have shown that this lifetime amounts at least to 8 or 12 months. For the user of the printing form attachment means of the invention this means a considerable economy, since when using a conventional printing form attachment means it generally has to be replaced after removal of a printing form one or more times, whereas as a result of the remaining of glue residues on the printing form it mostly has to be thrown away.

As appears from the drawings the photopolymeric layer 3 has a considerable thickness with respect to the adherent layers 5, 6. This results in advantageous utilization of the resilient characteristic of the photopolymeric layer 3, as a consequence of which the non-circular shape of the plate cylinder and the bearings of the plate cylinder can be taken away and a considerable noise reduction and a lifetime increase of the printing press are achieved. Moreover a relatively resilient support of the printing form 8 is realized, which increases the lifetime of the printing form. The quality of the printed matter is also improved, particularly in case of printing on rough material.

Furthermore, the use of a relatively thick photopolymeric layer 3 on the printing form attachment means 1 has the advantage that the thickness of the printing form 8 itself can be less so that a considerable economy of 25 to 40% on material costs for producing the printing forms can be realized.

As indicated schematically in FIGS. 1 and 2 reference markers 11 are provided to the photopolymeric layer 3 so that before applying the printing forms on the plate cylinder after applying the printing form attachment means 1 upon the plate cylinder 7 reference markers for positioning the printing forms are available. In this way the user can rapidly and precisely locate printing forms on the desired place. Alternatively it is possible to print the reference markers 11 on the supporting layer 2 in case of a suitable embodiment of the connection between the supporting layer and the photopolymeric layer.

The photopolymeric layer 3 can have various thicknesses ranging from e.g. 1 to 4 mm, dependent on the desire of the user. The thickness to be applied is dependent on the required height of the printing form for the relative printing press. The photopolymeric material has the advantage that it is resistant to the solvents present in the used inks, as well as to the influence of ozone.

Although in the foregoing the invention is explained by means of an application for attaching printing forms on a print cylinder it will be understood that the printing form attachment means of the invention can also be used for mounting and positioning of characters, numbers and pictures on other printing apparatus, amongst which encoding apparatus, stamping apparatus etc.

Furthermore it has to be noted that for applying the printing form attachment means on a magnetic plate cylinder the printing form attachment means can be provided with a thin metallic sheet. Alternatively the printing form attachment means can be laminated with a magnetic foil. It should be remarked here that it is known per se from DE-A-2 848 830 to attach a printing plat magnetically to a magnetic plate cylinder. The present embodiment, however, contemplates to attach the printing plate attachment means magnetically to a plate cylinder and to attach the printing plate subsequently to the photopolymeric printing plate attachment means already present on the plate cylinder. Printing plates themselves therefore do not need magnetic or magnetizable layers.

I claim:

1. Printing form attachment means (1) for removably attaching a flexographic printing form (8) made of a photopolymeric material by adhesion on a plate cylinder (7) of a printing press, characterized in that the printing form attachment means (1) comprises a completely exposed photopolymeric printing form attachment layer (3) made of a photopolymeric material adapted to be located on the plate cylinder (7) for removable adherent attachment of the printing form (8) to the plate cylinder (7) utilizing the adherent and sticky characteristics of the photopolymeric material, as well as a flexible support layer (2) which supports the photopolymeric printing form attachment layer (3).

2. Printing form attachment means (1) according to claim 1, characterized in that the photopolymeric printing form attachment layer (3) has a thickness of 1–4 mm.

3. Printing form attachment means (1) according to claim 2, characterized in that the printing form attachment layer (3) has a thickness of at least 1.5 mm.

4. Printing form attachment means (1) according to claim 1, characterized in that reference markers (11) are present on the photopolymeric printing form attachment layer (3) and/or the support layer (2) which is visible through the transparent printing form attachment layer (3).

5. Printing form attachment means (1) according to claim 1, characterized in that the support layer (2) is provided on the side opposite to the photopolymeric printing form attachment layer (3) with a further adherent layer (6) for removably attaching the printing form attachment means (1) on a plate cylinder of a printing press.

6. Printing form attachment means (1) according to claim 1, characterized in that a thin metallic sheet is provided for removably attaching the printing form attachment means on a plate cylinder (7) of a printing press.

7. Printing form attachment means (1) according to claim 1, characterized by a thin magnetic foil for removably attaching the printing form attachment means (1) on a plate cylinder (7) of a printing press.

8. Method for producing a printing form attachment means (1) according to claim 1, wherein an adherent photopolymeric layer (3) for the removable attachment of the printing form is applied to a support layer (2), characterized in that the photopolymeric layer (3) is completely exposed.

* * * * *

US005715750C1

(12) EX PARTE REEXAMINATION CERTIFICATE (5890th)

United States Patent

Goovaard

(10) Number: US 5,715,750 C1

(45) Certificate Issued: Sep. 18, 2007

(54) PRINTING FORM ATTACHMENT MEANS

(75) Inventor: Jan Goovaard, AH Driebergen (NL)

(73) Assignee: Winkle Holding, B.V., Amersfoort (NL)

Reexamination Request:
No. 90/007,083, Jun. 16, 2004

Reexamination Certificate for:

| | |
|---|---|
| Patent No.: | **5,715,750** |
| Issued: | **Feb. 10, 1998** |
| Appl. No.: | **08/669,413** |
| Filed: | **Sep. 23, 1996** |

(22) PCT Filed: Jan. 13, 1995

(86) PCT No.: PCT/NL95/00016

§ 371 (c)(1),
(2), (4) Date: Sep. 23, 1996

(87) PCT Pub. No.: WO95/19267

PCT Pub. Date: Jul. 20, 1996

(30) Foreign Application Priority Data

Jan. 13, 1994 (NL) ..... 9400057

(51) Int. Cl.
*B41F 27/00* (2006.01)

(52) U.S. Cl. ..... 101/382.1; 101/401.1

(58) Field of Classification Search ..... 101/395, 101/401.1, 382.1, 383; 430/14, 271.1
See application file for complete search history.

(56) References Cited

U.S. PATENT DOCUMENTS

| | | | |
|---|---|---|---|
| 3,210,187 | A | 10/1965 | Thomas |
| 4,871,631 | A | 10/1989 | Pieper et al. |

FOREIGN PATENT DOCUMENTS

| | | |
|---|---|---|
| JP | 61-204739 | 12/1986 |
| JP | 62-43819 | 11/1987 |
| JP | 1-188396 | 7/1989 |

OTHER PUBLICATIONS

*IUPAC Compendium of Chemical Technology*, 2nd Ed., 1997, definitions of "photosensitization" and "photopolymerization."

*Webster's II New College Dictionary*, 2001, pp. 829 and 943.

*McGraw–Hill Dictionary of Chemistry*, 1997, p. 300.

*Primary Examiner*—Margaret Rubin

(57) ABSTRACT

A printing form attachment device is provided for removably attaching a flexographic printing form made of a photopolymeric material by adhesion on a plate cylinder of a printing press. The printing form attachment device includes a completely exposed photopolymeric printing form attachment layer (3) made of a photopolymeric material located on the plate cylinder (7) for removable adherent attachment of the printing form to the plate cylinder utilizing the adherent and sticky characteristics of the photopolymeric material. A flexible support layer (2) is provided which supports the photopolymeric printing form attachment layer (3).

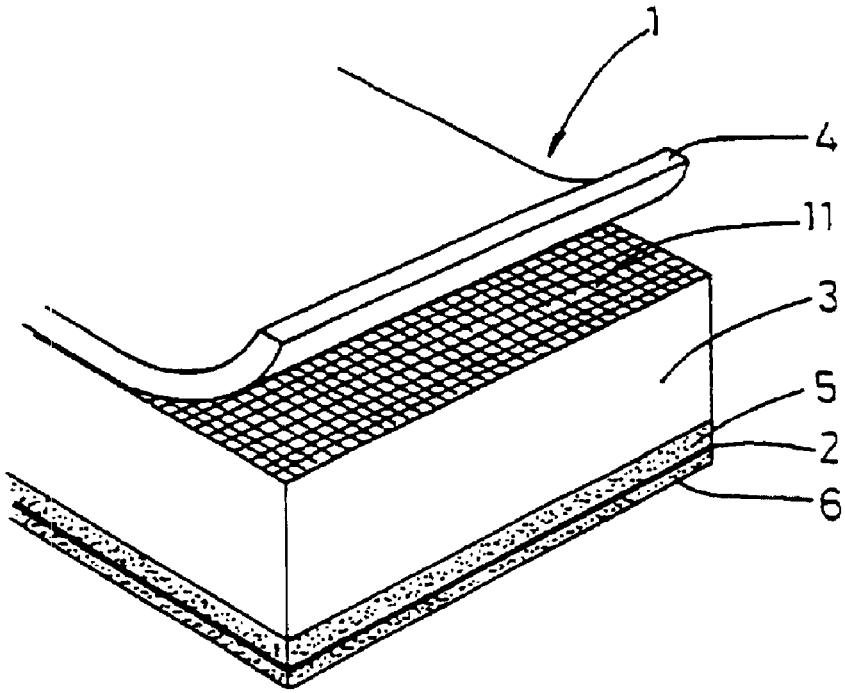

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4 are cancelled.

Claims 5–8 are determined to be patentable as amended.

New claims 9 and 10 are added and determined to be patentable.

5.[P] *The p*rinting form attachment means (1) according to claim [1]*9*, characterized in that the support layer (2) is provided on the side opposite to the photopolymeric printing form attachment layer (3) with a further adherent layer (6) for removably attaching the printing form attachment means (1) on a plate cylinder of a printing press.

6. [P]*The p*rinting form attachment means (1) according to claim [1]*9*, characterized in that a thin metallic sheet is provided for removably attaching the printing form attachment means on a plate cylinder (7) of a printing press.

7. [P]*The p*rinting form attachment means (1) according to claim [1]*9*, characterized by a thin metallic foil for removably attaching the printing form attachment means (1) on a plate cylinder (7) of a printing press.

8. [Method for producing a]*The* printing form attachment means (1) according to claim [1]*9*, wherein an adherent photopolymeric layer (3) for the removable attachment of the printing form is applied to a support layer (2), characterized in that the photopolymeric layer (3) is completely exposed.

*9. A printing form attachment means (1) for removably attaching a flexographic printing form (8) made of a photopolymeric material by adhesion on a plate cylinder (7) of a printing press, wherein the printing form attachment means (1) comprises a completely exposed printing form attachment layer (3) made of a photopolymeric material adapted to be located on the plate cylinder (7) for removable adherent attachment of the printing form (8) to the plate cylinder (7) by utilizing sticky characteristics of the photopolymeric material, as well as a flexible support layer (2) which supports the printing form attachment layer (3), and wherein the printing form attachment layer (3) has a thickness of two or four millimeters.*

*10. A printing form attachment means (1) for removably attaching a flexographic printing form (8) made of a photopolymeric material by adhesion on a plate cylinder (7) of a printing press, wherein the printing form attachment means (1) comprises a completely exposed transparent printing form attachment layer (3) made of a photopolymeric material adapted to be located on the plate cylinder (7) for removable adherent attachment of the printing form (8) to the plate cylinder (7) by utilizing adherent and sticky characteristics of the photopolymeric material, as well as a flexible support layer (2) which supports the printing form attachment layer (3), wherein the printing form attachment layer (3) has a thickness of two to four millimeters and wherein reference markers (11) are present on at least one of the printing form attachment layer (3) and the support layer which are visible through the transparent printing form attachment layer (3).*

* * * * *